US012035856B2

(12) United States Patent
Lian

(10) Patent No.: US 12,035,856 B2
(45) Date of Patent: Jul. 16, 2024

(54) MOUTHWASH DISPENSER CAPABLE OF AUTOMATIC SENSING AND SUPPLY

(71) Applicant: Binglian Lian, Zhongshan (CN)

(72) Inventor: Binglian Lian, Zhongshan (CN)

( * ) Notice: Subject to any disclaimer, the term of this patent is extended or adjusted under 35 U.S.C. 154(b) by 0 days.

(21) Appl. No.: 18/473,178

(22) Filed: Sep. 22, 2023

(65) Prior Publication Data

US 2024/0099520 A1 Mar. 28, 2024

(30) Foreign Application Priority Data

Sep. 24, 2022 (CN) ..... 202222531457.8

(51) Int. Cl.
*A47K 5/18* (2006.01)

(52) U.S. Cl.
CPC ..... *A47K 5/18* (2013.01)

(58) Field of Classification Search
CPC ..... A47K 5/18
See application file for complete search history.

(56) References Cited

U.S. PATENT DOCUMENTS

2018/0193121 A1* 7/2018 Zhao ..... A61L 2/10
2020/0046175 A1* 2/2020 Jenkins ..... A61Q 11/00
2023/0309758 A1* 10/2023 Hafiz ..... A47K 5/18
222/129

* cited by examiner

*Primary Examiner* — Jason K Niesz

(57) ABSTRACT

A mouthwash dispenser capable of automatic sensing and supply, including a housing and a cup; wherein a side of the housing defines a liquid outlet, a storage chamber is defined in the housing, and a deflector device and a control main board are arranged in the housing; the deflector device is arranged with an inlet end connected to the storage chamber and an outlet end connected to the liquid outlet; the housing is arranged with a first sensor electrically coupled with the control main board in a proximity to the liquid outlet; the cup is arranged with a second sensor; a transmission signal is generated on the second sensor in response to the second sensor approaching the first sensor.

7 Claims, 8 Drawing Sheets

MOUTHWASH DISPENSER CAPABLE OF AUTOMATIC SENSING AND SUPPLY

CROSS REFERENCE

The present disclosure claims priority of Chinese Patent Application No. 202222531457.8, filed on Sep. 24, 2022, the entire contents of which are hereby incorporated by reference in their entirety.

TECHNICAL FIELD

The present disclosure relates to the technical field of intelligent devices, especially a mouthwash dispenser capable of automatic sensing and supply.

BACKGROUND

The use of mouthwash for gargling is not only able to clean the mouth and fresh breath, but also one of effective measures for preventing various oral diseases. In order to help the user to access mouthwash, mouthwash dispensing equipment is available on the market, but most of the equipment are controlled by a button to dispense the mouthwash. Each time the mouthwash is to be loaded and taken, it is required to manually press the button, which makes the operation more cumbersome. Further, the equipment has usually only a simple mouthwash-supply function, and cannot interact with a cup for loading and taking the mouthwash, lacking of fun. Therefore, the present disclosure provides a mouthwash dispenser capable of automatic sensing and supply, to solve the above problems in the related art.

SUMMARY OF THE DISCLOSURE

(1) Technical Problem Solved

In view of the deficiencies of the related art, the present disclosure provides a mouthwash dispenser capable of automatic sensing and supply to solve the above problems.

(2) Technical Solution

In order to realize the above purposes, the present disclosure provides the following technical solutions: a mouthwash dispenser capable of automatic sensing and supply, including a housing and a cup; wherein a side of the housing defines a liquid outlet, a storage chamber is defined in the housing, and a deflector device and a control main board are arranged in the housing; the deflector device is arranged with an inlet end connected to the storage chamber and an outlet end connected to the liquid outlet; the housing is arranged with a first sensor electrically coupled with the control main board in a proximity to the liquid outlet; the cup is arranged with a second sensor; a transmission signal is generated on the second sensor in response to the second sensor approaching the first sensor.

In some embodiments, the housing is arranged with a magnet at the first sensor, and the cup is correspondingly arranged with a magnetic suction member at the second sensor, the magnetic suction member being capable of being mutually attracted with the magnet.

In some embodiments, the housing is arranged with a placement part under the liquid outlet for placing the cup, and the first sensor is arranged on a side of the placement part.

In some embodiments, the housing includes a top cover and a base; the storage chamber is defined in the base with an opening facing upward, the top cover is detachably arranged on a top of the base and configured to cover the opening of the storage chamber, and the liquid outlet, the deflector device, and the control main board are arranged on the top cover.

In some embodiments, a switch button and a gear button are arranged on a side of the placement part, and the switch button and the gear button are electrically connected to the control main board.

In some embodiments, a display is arranged on a side within the housing, and the display is electrically connected to the control main board.

In some embodiments, a battery is arranged in the housing, and the battery is electrically connected to the control main board.

(3) Beneficial Effects

The beneficial effects of the present disclosure are as followed.

A. Through the sensing of the output coil and the receiving coil, the automatic liquid supply from the mouthwash dispenser may be realized, thereby avoiding the cumbersome operation of pressing a button to control the liquid supply, and thus improving the usage experience.

B. By utilizing the output coil for the transmission of power supply to the receiving coil, the brightness and extinction of the LED light on the bottom of the cup is combined with the starting and stopping of the liquid supply of the mouthwash dispenser, such that the cup may interact with the mouthwash dispenser, thereby enhancing the fun of the loading and taking operations of the mouthwash.

C. The magnetic suction member at the bottom of the cup can be mutually attracted with the magnet, so as to facilitate positioning and fixing of the cup, and aligning the receiving coil to the output coil, thereby enhancing the convenience of placing the cup.

BRIEF DESCRIPTION OF THE DRAWINGS

The accompanying drawings are intended to provide a further understanding of the present disclosure and form part of the specification, and aims, in conjunction with the embodiments of the present disclosure, for the purpose of explaining the present disclosure and do not constitute a limitation of the present disclosure.

Figure 1:
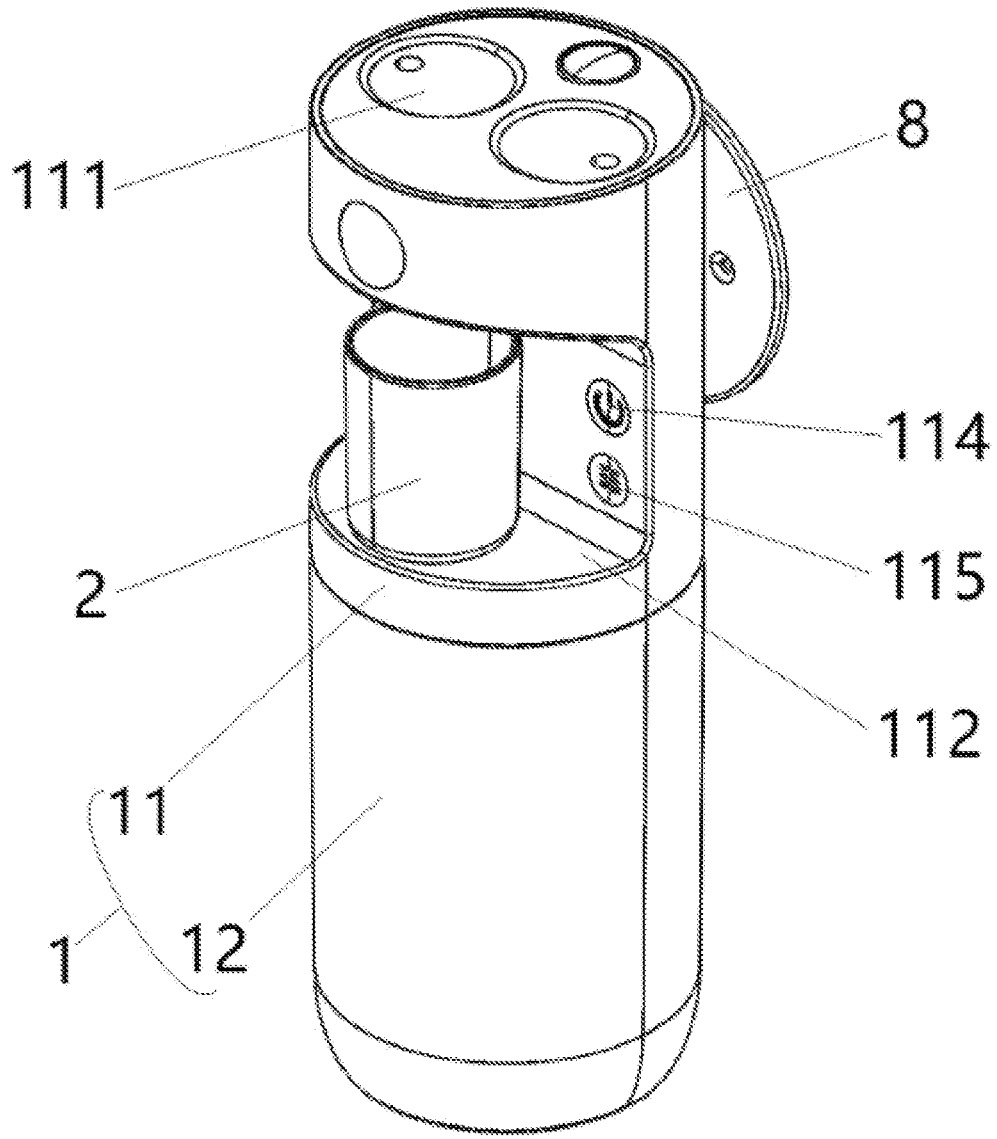
FIG. 1 is a schematic view of an appearance according to the present disclosure.

Reference numerals: 1 housing, 11 top cover, 110 liquid outlet, 111 cup slot, 112 placement part, 113 fitting plate, 114 switch button, 115 gear button, 116 display, 117 battery, 118 charging socket, 12 base, 120 storage chamber, 2 cup, 3 deflector device, 4 control main board, 51 output coil, 52 receiving coil, 6 light-emitting device, 71 magnet, 72 magnetic suction member, 8 fixing plate, 81 fitting slot.

DETAILED DESCRIPTION

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure and not all of the embodiments. Based on the embodiments in the present disclosure, all other embodiments obtained by those skilled in the art without making creative labor are within the scope of the present disclosure.

Figure 2:
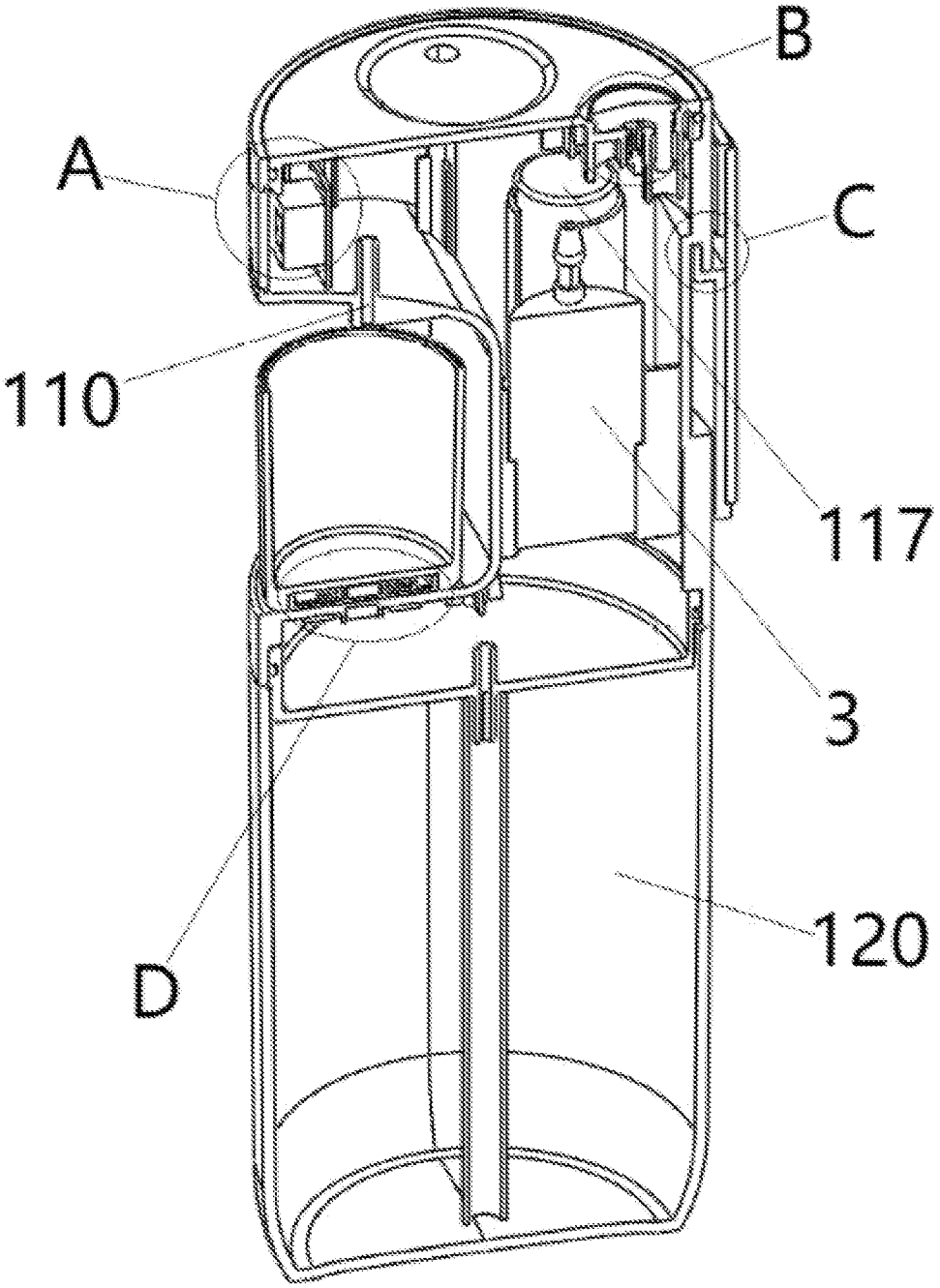
FIG. 2 is a cross-sectional schematic view according to the present disclosure.
Figure 3:
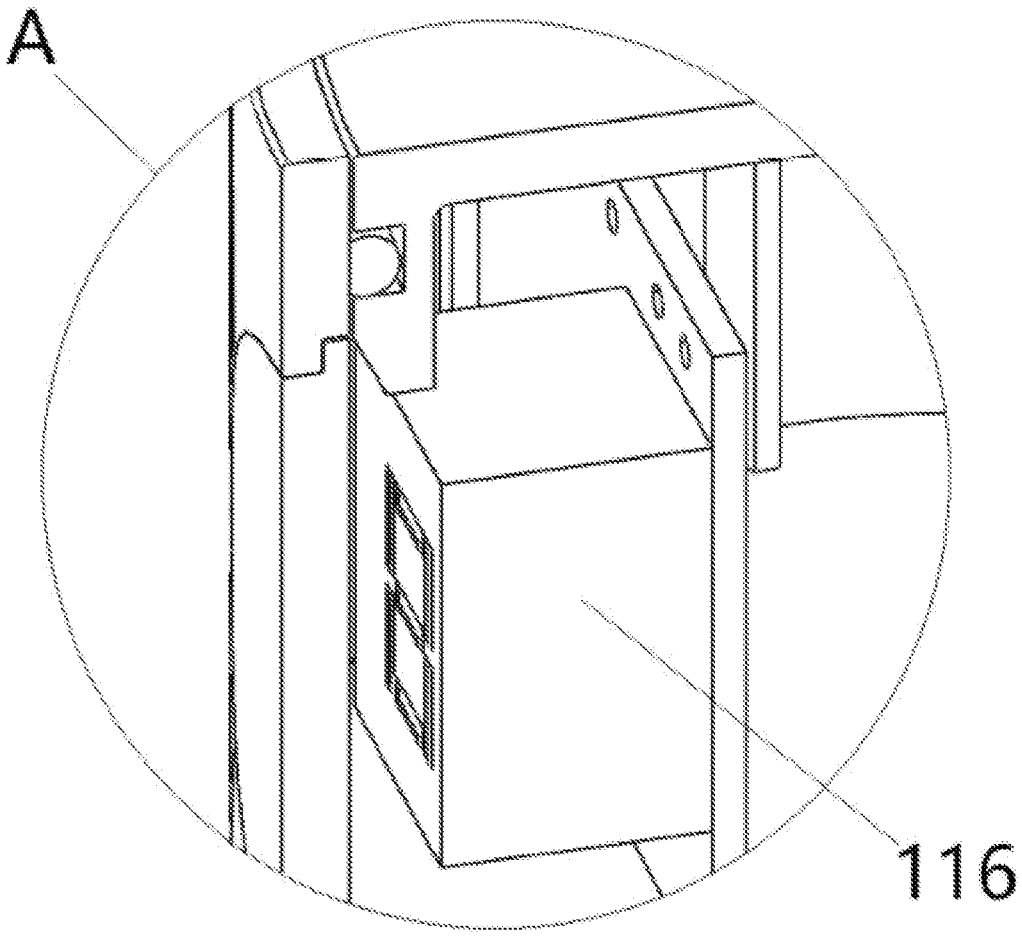
FIG. 3 is an enlarged view of area A in FIG. 2.
Figure 4:
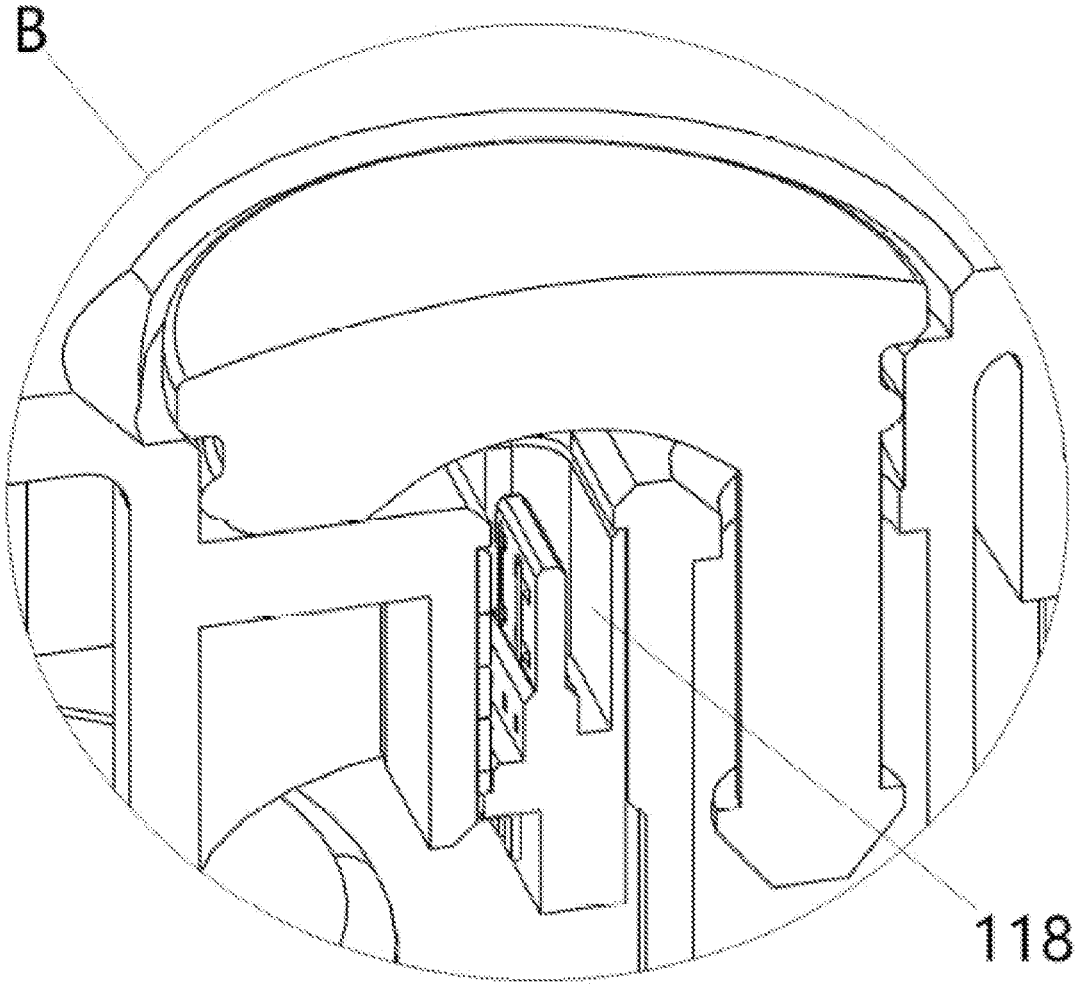
FIG. 4 is an enlarged view of area B in FIG. 2.
Figure 5:
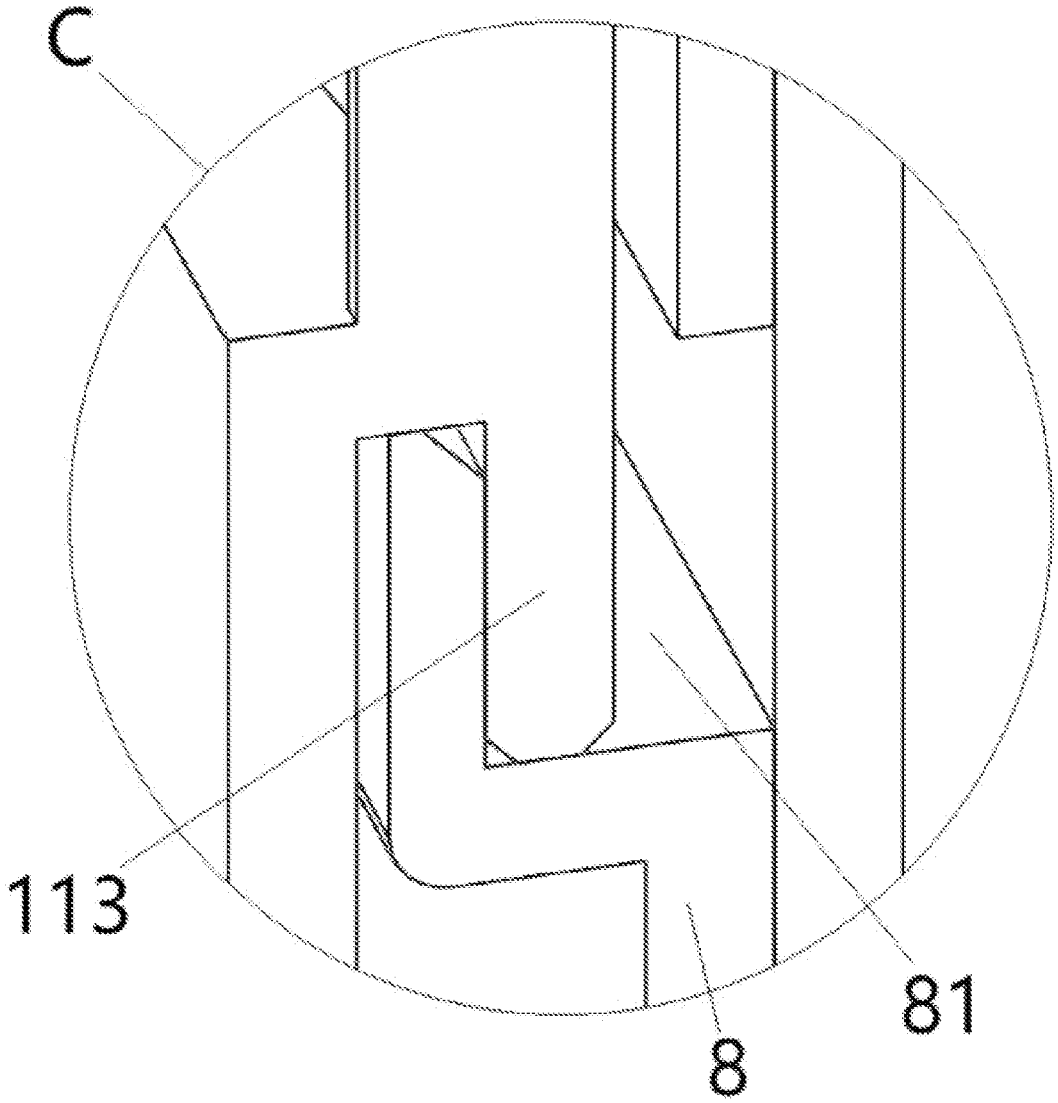
FIG. 5 is an enlarged view of area C in FIG. 2.
Figure 6:
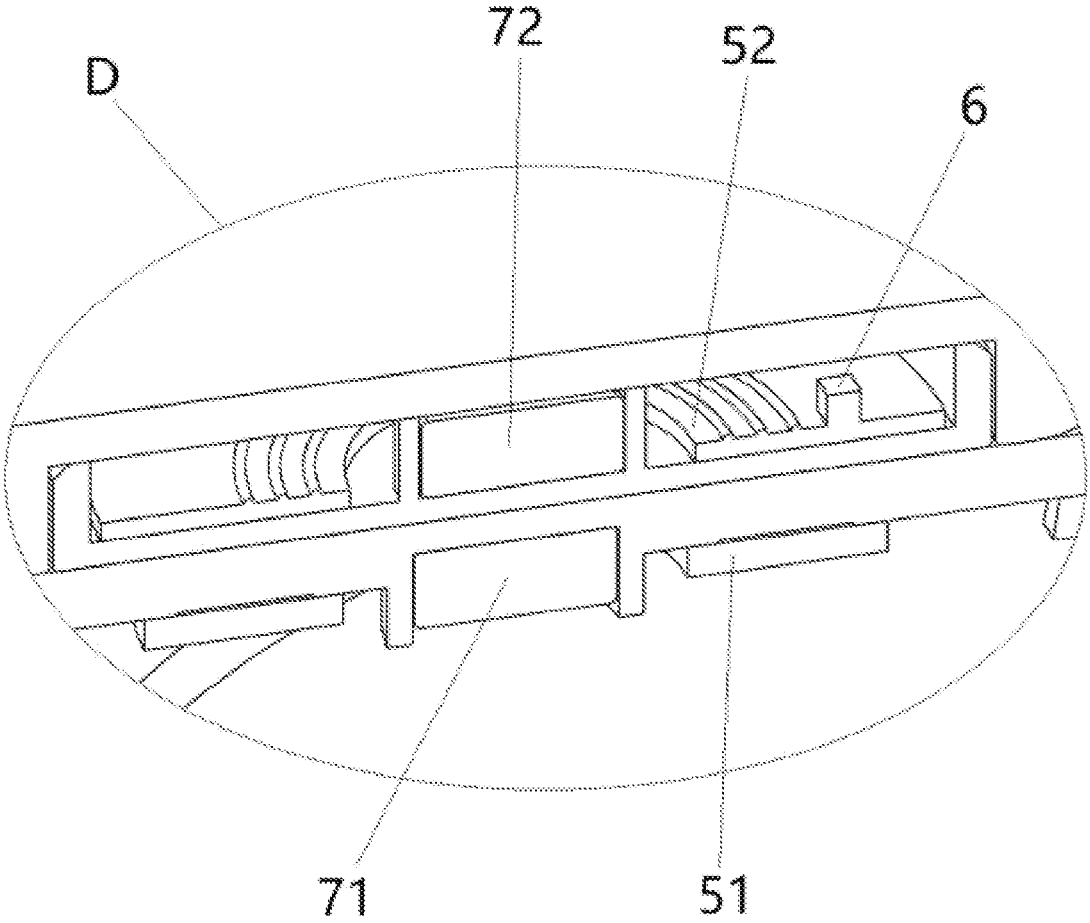
FIG. 6 is an enlarged view of area D in FIG. 2.
Figure 7:
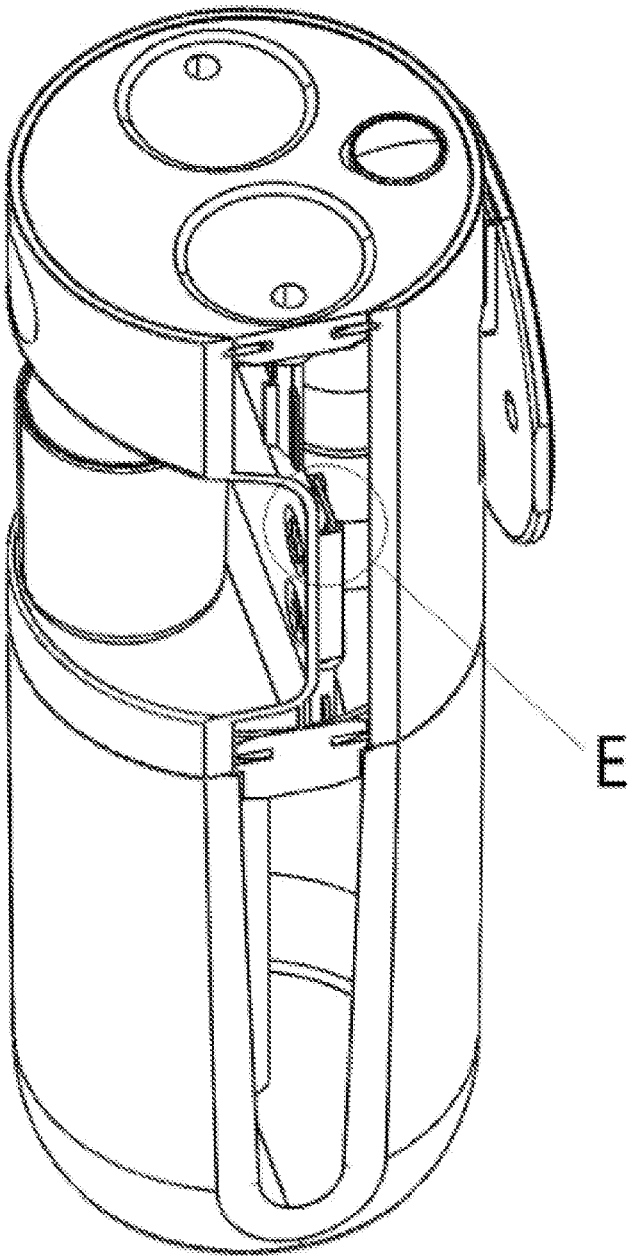
FIG. 7 is another cross-sectional schematic view according to the present disclosure.
Figure 8:
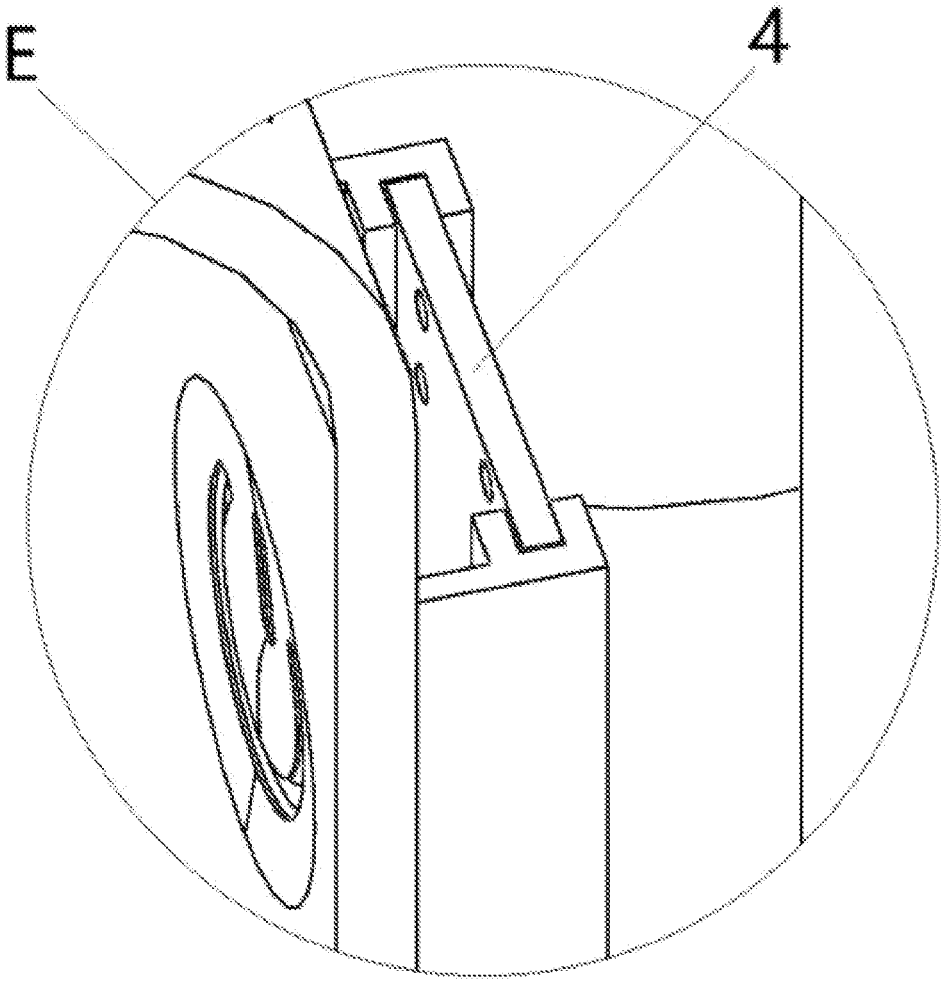
FIG. 8 is an enlarged view of area E in FIG. 7.

Referring to FIGS. 1-8, provided is a mouthwash dispenser capable of automatic sensing and supply, including a housing 1 and a cup 2; wherein a side of the housing 1 defines a liquid outlet 110, a storage chamber 120 is defined in the housing 1, and a deflector device 3 and a control main board 4 are arranged in the housing 1; the deflector device 3 is arranged with an inlet end connected to the storage chamber 120 and an outlet end connected to the liquid outlet 110; the housing 1 is arranged with an output coil 51 electrically coupled with the control main board 4 in a proximity to the liquid outlet 110; the cup 2 is arranged with a receiving coil 52 and a light-emitting device 6; a current is generated on the receiving coil 52 in response to the receiving coil 52 approaching the output coil 51.

Specifically, the deflector device 3 may be a water pump and is electrically connected to the control main board 4, the receiving coil 52 is electrically connected to the light-emitting device 6, and the control main board 4 functions in condition of being connected to an external power supply through a wire; in response to the receiving coil 52 approaching the output coil 51, the output coil 51 cause the current to be generated on the receiving coil 52 under an action of an alternating magnetic field, and at the same time, the output coil 51 generates a change in its own current, and this technology is an existing wireless charging technology, which is not specifically described in the embodiments; the output coil 51 may be placed vertically or horizontally, preferably horizontally; the receiving coil 52 and the light-emitting device 6 are arranged at a bottom of the cup 2; the light-emitting device 6 may be an light-emitting diode (LED) light of any color, preferably blue, and the cup 2 may be made of a translucent material; a top of the housing 1 defines a cup slot 111 for a user to place the cup 2; the inlet end and outlet end of the water pump are connected to the storage chamber 120 and the liquid outlet 110 through a pipe, respectively.

In summary, when the user uses the cup 2, the user only needs to place the cup 2, with an opening facing upward, on a plane where the receiving coil 52 is arranged of the housing 1, in which case the receiving coil 52 generates the current to illuminate the LED light; the control main board 4 detects the change in the current of the output coil 51 and activates the water pump, which extracts mouthwash inside the storage chamber 120 and conveys the mouthwash to the liquid outlet 110 to flow out, so as to cause the mouthwash to drip into the cup 2; after a certain amount of the mouthwash has been extracted, the control board 4 shuts down the water pump, and at the same time disconnects power supply to the output coil 51, such that the LED light is off. Through the sensing of the output coil 51 and the receiving coil 52, the automatic liquid supply from the mouthwash dispenser may be realized, thereby avoiding the cumbersome operation of pressing a button to control the liquid supply. In addition, by utilizing the output coil 51 for the transmission of power supply to the receiving coil 52, the brightness and extinction of the LED light on the bottom of the cup 2 is combined with the starting and stopping of the liquid supply of the mouthwash dispenser, such that the cup 2 may interact with the mouthwash dispenser, thereby enhancing the fun of the loading and taking operations of the mouthwash.

Further, the housing 1 is arranged with a magnet 71 at the output coil 51, and the cup 2 is correspondingly arranged with a magnetic suction member 72 at the receiving coil 52 that can be mutually attracted with the magnet 71. When the cup 2 is placed at the plane where the receiving coil 52 is arranged of the housing 1, the magnetic suction member 72 at the bottom of the cup 2 can be mutually attracted with the magnet 71, so as to facilitate positioning and fixing of the cup 2, and aligning the receiving coil 52 to the output coil 51, thereby enhancing the convenience of placing the cup 2.

Further, the housing 1 is arranged with a placement part 112 for placing the cup 2 under the liquid outlet 110, and the output coil 51 is arranged on a side of the placement part 112; specifically, the output coil 51 is arranged on a horizontal side at a bottom of the placement part 112, such that the cup 2 can be placed horizontally under the liquid outlet 110. The magnet 71 is arranged at a middle position of the output coil 51, and the magnetic suction member 72 is correspondingly arranged at a middle position of the receiving coil 52 at the bottom of the cup 2.

Further, the housing 1 includes a top cover 11 and a base 12; the storage chamber 120 is defined in the base 12 with an opening facing upward, the top cover 11 is detachably arranged on a top of the base 12 and configured to cover the opening of the storage chamber 120, and the liquid outlet 110, the deflector device 3, and the control main board 4 are arranged on the top cover 11.

Specifically, the connection between the top cover 11 and the base 12 may be screwed together by means of threads, such that the user may remove the top cover 11 to replenish the mouthwash in the storage chamber 120, and thus the mouthwash dispenser may be used in a circular manner; a side of the top cover 11 away from the liquid outlet 110 is arranged with a fitting plate 113 facing downward, a fixing plate 8 is arranged on a side of the fitting plate 113, and a side of the fixing plate 8 facing the fitting plate 113 defines a fitting slot 81 facing upward, that matches with the fitting plate 113 in a slidable manner; a back side of the fixing plate 8 is arranged with a double-sided adhesive sticker, such that the user may fix the fixing plate 8 on a wall through the adhesive sticker, allowing the mouthwash dispenser to be hung and used.

Further, a switch button 114 and a gear button 115 are arranged on a side of the placement part 112, and the switch button 114 and the gear button 115 are electrically connected to the control main board 4; the switch button 114 is configured to control starting and stopping of the control main board 4, and the gear button 115 is configured to control the control main board 4 to switch between a plurality of supplying modes, where a number of the plurality of supplying modes is more than or equal to three, and corresponding supplying quantities are respectively 10 ml, 20 ml, and 30 ml.

Further, a display 116 is arranged on a side within the housing 1, and the display 116 is electrically connected to the control main board 4.

Specifically, the display 116 is a double-8 digital tube for displaying a value corresponding to the switching of gears.

In addition, when the mouthwash dispenser completes the liquid supply and the user picks up the cup 2, the double-8 digital tube automatically counts down for 20 seconds and then automatically turn off; when the cup 2 is replaced in the process of counting down, the liquid supply is not triggered.

Further, a battery 117 is arranged in the housing 1, and the battery 117 is electrically connected to the control main board 4.

Specifically, the battery 117 is arranged to facilitate the use of the mouthwash dispenser off the wire, such that the placement of the mouthwash dispenser is not restricted; a charging socket 118 is arranged on a side of the top cover 11 and electrically connected to the battery 117, such that the battery 117 is charged for cyclic use.

It is noted that the terms used herein are intended only to describe specific implementations and are not intended to limit the exemplary implementations according to the present disclosure. As used herein, the singular form is intended to include the plural form as well, unless the context clearly indicates otherwise, and it should also be understood that when the terms "comprising" and/or "including" are used in this specification, they indicate the presence of features, steps, operations, devices, components, and/or combinations thereof.

The relative arrangement, numerical expressions, and values of the components and steps set forth in these embodiments do not limit the scope of the present disclosure unless otherwise specified. In addition, it should be understood that the dimensions of the various parts shown in the accompanying drawings are not drawn in actual proportional relationship for ease of description. Techniques, methods, and apparatus known to those skilled in the art may not be discussed in detail, but where appropriate, said techniques, methods, and apparatus should be considered part of the specification. In all of the examples illustrated and discussed herein, any specific values should be interpreted as merely exemplary and not as limitations. Therefore, other examples of exemplary embodiments may have different values. It should be noted that: similar symbols and letters denote similar items in the following accompanying drawings, and therefore, once an item is defined in an accompanying drawing, no further discussion of it is required in the subsequent accompanying drawings.

In the description of the present disclosure, it is to be understood that orientation terms such as "front, back, top, bottom, left, right", "lateral, vertical, vertical, horizontal" and "top, bottom" indicate an orientation or positional relationship that is generally based on a number of different types of orientation words. The orientation or positional relationships indicated by these terms are generally based on the orientation or positional relationships shown in the accompanying drawings, and are only for the purpose of facilitating the description of the present disclosure and simplifying the description. In the absence of any indication to the contrary, these terms do not indicate and imply that the device or element referred to must have a specific orientation or be constructed and operated in a specific orientation, and therefore cannot be construed as a limitation on the scope of the present disclosure; the terms "inside, outside" refer to inside and outside in relation to the contour of a component.

For ease of description, spatially relative terms may be used herein, such as "above . . . ", "on top of . . . ", "on an upper surface of . . . ", "above", etc., to describe the spatial location relationship of a device or feature in relation to other devices or features as shown in the figures. It should be understood that the spatially relative terms are intended to encompass different orientations in use or operation in addition to the orientation of the device depicted in the figures. For example, if the devices in the accompanying drawings are inverted, a device or configuration described as "above" or "on top of" another device or configuration would later be positioned as "below" or "on bottom of" the other device or configuration. Therefore, the exemplary term "above . . . " may include "above . . . " and "below . . . ". The device may also be positioned in other different ways (rotated 90 degrees or in other orientations) and the spatial relative descriptions used herein are explained accordingly.

In addition, it should be noted that the use of terms such as "first" and "second" to qualify the parts is merely for the purpose of facilitating the differentiation of the corresponding parts, and the terms do not have special meanings if not otherwise declared, and therefore should not be construed as a limitation of the scope of the present disclosure.

Although the embodiments of the present disclosure have been shown and described, it is understood by those skilled in the art that a variety of changes, modifications, substitutions, and variants can be made to these embodiments without departing from the principle and spirit of the present disclosure, and the scope of the present disclosure is limited by the appended claims and their equivalents.

What is claimed is:

1. A mouthwash dispenser capable of automatic sensing and supply, comprising a housing (1) and a cup (2); wherein a side of the housing (1) defines a liquid outlet (110), a storage chamber (120) is defined in the housing (1), and a deflector device (3) and a control main board (4) are arranged in the housing (1); the deflector device (3) is arranged with an inlet end connected to the storage chamber (120) and an outlet end connected to the liquid outlet (110); the housing (1) is arranged with an output coil (51) electrically coupled with the control main board (4) in a proximity to the liquid outlet (110); the cup (2) is arranged with a receiving coil (52); a current is generated on the receiving coil (52) in response to the receiving coil (52) approaching the output coil (51).

2. The mouthwash dispenser according to claim 1, wherein the housing (1) is arranged with a magnet (71) at the output coil (51), and the cup (2) is correspondingly arranged with a magnetic suction member (72) at the receiving coil (52), the magnetic suction member (72) being capable of being mutually attracted with the magnet (71).

3. The mouthwash dispenser according to claim 1, wherein the housing (1) comprises a top cover (11) and a base (12); the storage chamber (120) is defined in the base (12) with an opening facing upward, the top cover (11) is detachably arranged on a top of the base (12) and configured to cover the opening of the storage chamber (120), and the liquid outlet (110), the deflector device (3), and the control main board (4) are arranged on the top cover (11).

4. The mouthwash dispenser according to claim 1, wherein a battery (117) is arranged in the housing (1), and the battery (117) is electrically connected to the control main board (4).

5. The mouthwash dispenser according to claim 1, wherein the housing (1) is arranged with a placement part (112) under the liquid outlet (110) for placing the cup (2), and the output coil (51) is arranged on a side of the placement part (112).

6. The mouthwash dispenser according to claim 5, wherein a switch button (114) and a gear button (115) are arranged on a side of the placement part (112), and the switch button (114) and the gear button (115) are electrically connected to the control main board (4); wherein the gear button (115) is configured to control the control main board (4) to switch between a plurality of supplying modes, and a number of the plurality of supplying modes is more than or equal to three.

7. The mouthwash dispenser according to claim 6, wherein a display (116) is arranged on a side within the housing (1), and the display (116) is electrically connected to the control main board (4).

* * * * *